United States Patent [19]

Hagen et al.

[11] Patent Number: 4,848,633

[45] Date of Patent: Jul. 18, 1989

[54] NON-CONTACT WEB TURNING AND DRYING APPARATUS

[75] Inventors: Kenneth G. Hagen, Cape Elizabeth, Me.; E. Sam Fontain, Auburn; David J. Fadden, Framingham, both of Mass.; William L. Henshilwood, Winnecomne, Wis.

[73] Assignee: Thermo Electron Web Systems, Inc., Auburn, Mass.

[21] Appl. No.: 835,048

[22] Filed: Feb. 28, 1986

[51] Int. Cl.[4] ..... B65H 20/14

[52] U.S. Cl. ..... 226/97; 34/156

[58] Field of Search ..... 226/97, 196, 197; 34/156, 160

[56] References Cited

U.S. PATENT DOCUMENTS

| | | | |
|---|---|---|---|
| 3,587,177 | 6/1971 | Overly | 34/156 |
| 4,069,595 | 1/1978 | Ahlbert et al. | 226/97 X |
| 4,197,972 | 4/1980 | Daane | 226/97 |
| 4,218,833 | 8/1980 | Coar | 226/97 X |
| 4,282,998 | 8/1981 | Peekna | 226/97 |
| 4,288,015 | 9/1981 | Curtin | 226/97 |
| 4,414,757 | 11/1983 | Whipple | 34/156 X |
| 4,606,137 | 8/1986 | Whipple | 34/156 |

*Primary Examiner*—John M. Jillions

*Attorney, Agent, or Firm*—Lorusso & Loud

[57] ABSTRACT

Disclosed is an apparatus for transporting a web about a nonlinear path without allowing the apparatus to contact the web. The apparatus includes a series of positive pressure nozzles which emit a primary jet flow of fluid in a single direction, and a secondary jet flow of fluid in a direction perpendicular to the primary flow. The two flows merge and transport the web on a cushion of air along the nonlinear path. The magnitude of the cushioned pad is controlled by a series of slide dampers which are positioned between adjacent nozzles, and the opening of these slide dampers controls the amount of exhaust from the merged flow so as to control the cushioned path. The last nozzle in the series will direct its primary flow in a direction opposite to that of the other nozzles in the series in order to maintain the overall pressure pad under the web. In an alternate embodiment, a second set of nozzles which provide a negative pressure are arranged around the convex side of the web to provide additional stability and to enable the drying of the web on both sides of the web.

1 Claim, 3 Drawing Sheets

NON-CONTACT WEB TURNING AND DRYING APPARATUS

BACKGROUND OF THE INVENTION

This invention relates to papermaking, and more particularly to an apparatus and method for transporting a web along a nonlinear or curved path without allowing any machine components to come into contact with the web.

Coated paper or similar products are often manufactured in the form of a continuous web. The coating is applied to the web as a suspension in a solvent. The coated web is then passed through a dryer which removes the solvent leaving the desired dry coating on the surface of the web. The web can be paper, synthetic film or metallic foil, and the solvents used to apply the coating may be water or a wide variety of organic solvents or mixtures of solvents. Conventional heated cylinder dryers are usually unsuitable for the drying of such coated webs because the wet coating will stick to any contacted surface until it is substantially dry. For this reason, floater dryers have been developed and used to eliminate contact with a coated web prior to the drying of the coating on the web. The floater dryers float the web on a cushion of heated air, and these dryers dry the coating concurrently with providing non-contact support of the web as the web passes through the dryer.

At a coated web manufacturing installation, the floater dryers must be positioned with respect to the coater in a manner which enables the web to pass straight into the dryer from the coater without a change in direction which would require the coated side to contact a turning roll. Such a requirement severely restricts the arrangement of the various components, and the restrictions are even greater for machinery designed to coat simultaneously both sides of the web because there is no uncoated side that can be supported by a machine component. Ideally, a device which will support a moving web on a cushion of air as it makes the change of direction would solve many of these problems.

Apparatus which utilize an air cushion for floating and drying webs must insure the stability of the air flow with respect to the web to avoid harmful fluttering and related spurious movements of the web which can result in undesirable mechanical contact with the flow nozzles. In any turning device, the air cushion must also maintain sufficient pressure to react the components of the web tension which resist the turn.

Theoretical and experimental considerations show that floating a web on streams of air that flow parallel rather than perpendicular to the web results in orderly and stable web support while allowing a wide variety of nozzle-to-nozzle spacings to be utilized. Parallel air flow also provides for highly uniform heat transfer, and therefore drying, in both the cross machine and machine directions. U.S. Pat. No. 3,587,177 describes one type of nozzle which has been very successful in providing floatation drying utilizing a parallel flow of air. The device described in U.S. Pat. No. 3,587,177 creates a negative pressure which causes the web to run parallel to the nozzle face at a fixed distance on the order of 4–6 mm. Such nozzles can support a web from only one side or from both sides, and only along a straight line.

U.S. Pat. No. 4,414,757 provides another type of nozzle for the floatation drying of a coated web. This patent describes a device which creates a positive pressure cushion. For linear dryers, this nozzle must be used on both sides of a web in an alternate sequence in order to suitably react the positive pressure cushion and thereby control the movement of the web through the dryer.

It is therefore a principal object of the present invention to provide an apparatus for supporting a web for movement along a nonlinear path without contact between the apparatus and the web.

Another object of the present invention is to provide an apparatus for transporting and drying a coated web along a nonlinear path which does not require positioning machinery on both sides of the web.

Still another object of the present invention is to provide an apparatus for transporting and drying a coated web along a nonlinear path which can dry the coating on both sides of the web.

SUMMARY OF THE INVENTION

According to the present invention, an apparatus for transporting a web along a nonlinear path without subjecting the web to any contact with machine components is provided. The apparatus includes a plurality of positive pressure nozzles which are positioned along the path the web is to travel. The positive pressure nozzles are arranged so that a primary jet flow is directed in a single direction out of an orifice of the nozzle. A second orifice is also provided in each of the nozzles for supplying secondary jet flow which is a fraction of the flow of the primary jet flow. This secondary jet flow is directed perpendicular to the web before this flow merges with the primary flow. An additional nozzle which is identical to the remainder of the nozzles is placed adjacent the plurality of nozzles at the downstream end of plurality of nozzles. This additional nozzle is arranged in a reversed position relative the other nozzles, and the additional nozzle provides a primary jet flow in the opposite direction to maintain the overall pressure pad under the web at the downstream edge of the apparatus. A series of slide dampers are positioned between adjacent nozzles for adjusting the amount of exhaust flow from the air cushion created by the merged primary and secondary jet flows.

In one embodiment, a pressure tap is utilized to sense the pressure in the air cushion created by the merged flow. Also, in an alternate embodiment, a second series of nozzles is placed about the convex side of the web. These nozzles provide a negative pressure rather than the positive pressure produced by the nozzles on the concave side of the web. This second series of nozzles adds stability to the web and dries the opposite side of the web so that both sides of the web may be dried at the same time.

These and other features and objects of the present invention will be more fully understood from the following detailed description which should be read in light of the accompanying drawings in which corresponding reference numerals refer to corresponding parts throughout the several views.

DETAILED DESCRIPTION OF THE PREFERRED EMBODIMENTS

Figure 1:
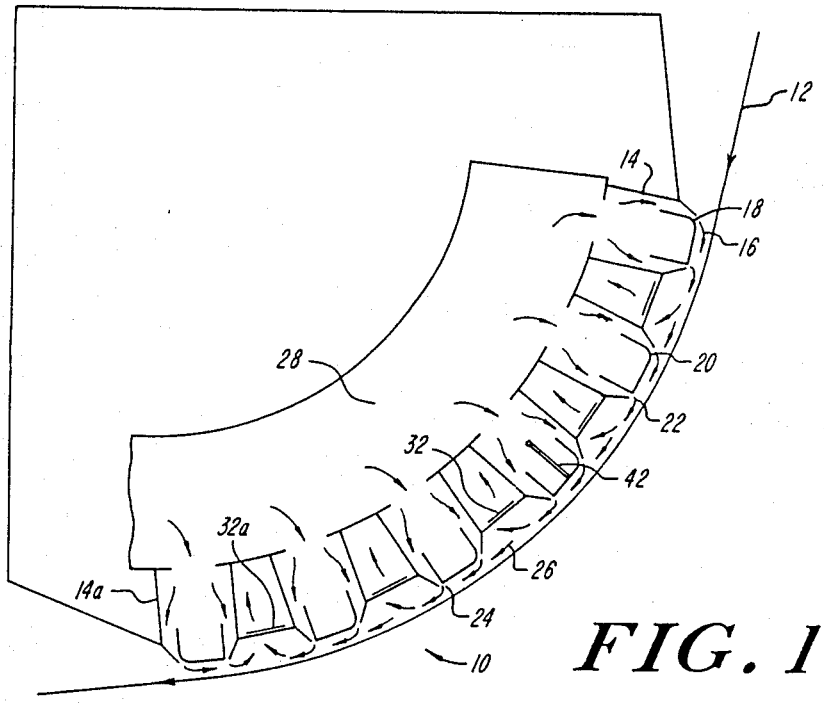
FIG. 1 is a sectional schematic view of the apparatus of the present invention for transporting a web along a nonlinear path.

Referring to FIG. 1, the apparatus of the present invention for transporting a web 12 along a nonlinear path of approximately 90° is shown. The apparatus 10 includes a plurality of positive pressure nozzles 14. Each nozzle 14 provides a primary jet stream of pressure fluid, designated by arrow 16, which emerges from a slot orifice 18 running the full width of the apparatus 10 and the web 12. This jet stream of fluid 16 follows the curved contour of the nozzle face 20, and the Coanda effect created by this curved face causes the jet flow to run parallel to the web 12. A secondary jet stream of approximately 35% to 40% of the flow of the primary jet stream 16 emerges from a secondary slot orifice 24 and is directed in a direction perpendicular to the web 12. This secondary jet flow 22, however, merges with the primary flow 16 to form a combined jet flow 26. The secondary jet flow 22 has the effect of back pressuring the primary jet flow to a degree sufficient to create a positive pressure pad. This back pressure, is not, however, sufficient to disrupt the parallel and unidirectional flow.

A sequence of the nozzles 14 are mounted on a curved supply header 28 in such a way that the jet flow from each of the nozzles, except for a single last nozzle, cause the primary jet flow 16 supplied by the nozzle to travel in a single direction. The last nozzle 14*a* is reversed relative to the other nozzles 14 to obstruct the flow from the other nozzles to maintain the overall pressure pad under the web 12. This reverse pressure flow enables the device to blow air into the space between the nozzles 14 and the web 12 at both the entering and leaving ends so that spurious flows interacting with the unsupported web extending out from each end of the apparatus 10 are avoided.

The pressure profile supporting the web is maintained by slide dampers 32 mounted in a space between each two adjacent nozzles 14. Slide dampers 32, which will be more fully described below, maintain the pressure profile by controlling the exhaust air leaving the air cushion. In normal operation, dampers 32 are nearly closed except for the damper 32*a* adjacent the reversed nozzle 30. Since damper 32*a* handles a significantly greater flow, the damper 32*a* is required to exhaust a greater amount of air, and therefore, the opening must be greater than the other damper openings. In FIG. 1, the primary direction of air flow is shown to be in the same direction as the web travel. This arrangement is preferable from the point of view of web stability, but the choice of co-flow or counter flow depends on a variety of factors including web weight, speed, etc.

A certain degree of misalignment of the web direction with respect to the planes of the first and last nozzles is permissible. In a preferred embodiment, the web 12 enters the apparatus 10 in a position in which it lies between 2° of overwrap and 6° of underwrap relative to the tangent line of the first nozzle. It is also preferred that the web 12 leaves the apparatus 10 in a direction between 7° of underwrap and 3° of overwrap with respect to the tangent line of the last nozzle 30.

Figure 2:
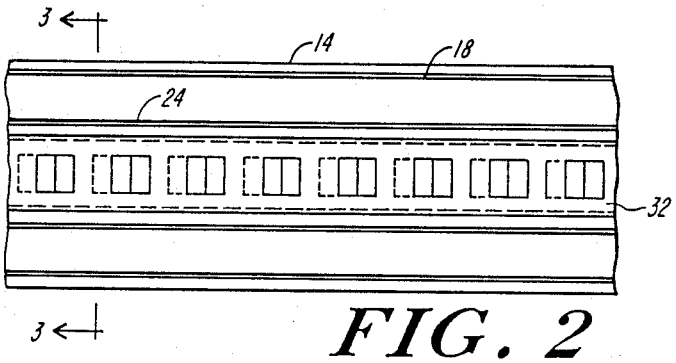
FIG. 2 is a plan view of a nozzle of the present invention as utilized in FIG. 1.
Figure 3:
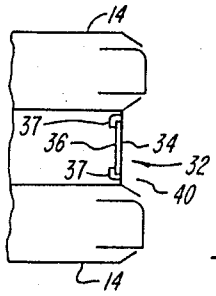
FIG. 3 is a sectional view of a nozzle taken along lines 3—3 of FIG. 2.

Referring to FIGS. 2 and 3, the slide dampers 32 are more clearly shown. The dampers 32 include a fixed plate 34 which is perforated with a plurality of holes which are preferably rectangular in shape. A moving plate 36 is also perforated with a plurality of holes, preferably of a rectangular shape, so that the plate 36 has a configuration similar to that of the fixed plate 34. The moving plate 36 is mounted in guides 37 to slide beneath the fixed plate 34 such that full misalignment of the holes provides maximum restriction of the exhaust flow, and full alignment provides maximum exhaust flow. By being positioned beneath the fixed plate 34, it is meant that the moving plate 36 is positioned on the side of said fixed plate opposite the side of the fixed plate adjacent the web. (The moving and fixed plates 34, 36 could, of course, be reversed so that the moving plate is adjacent the web.) The dampers 32 are utilized to balance the pressure pad to control the uniformity of the distance at which the web rides away from the nozzles 14.

Figure 4:
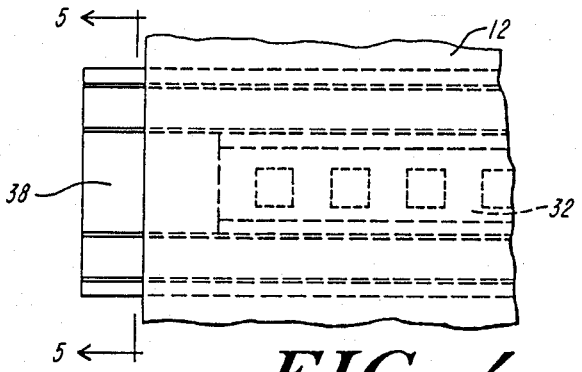
FIG. 4 is a plan view of one end of the nozzle shown in FIG. 2.
Figure 5:
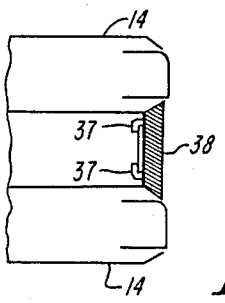
FIG. 5 is a sectional view of a nozzle taken along lines 5—5 of FIG. 4.

To restrict the sideways flow of the air cushion from the space between the nozzles 14, the slide dampers 32 and the web 12, edge deckles 38 are provided. As shown in FIGS. 4 and 5, the edge deckles 38 fill the pockets 40 at the edges of the apparatus 10 so that the surface of the deckles 38 is flush with the end surface of the nozzle 14. The deckles have sufficient length in the cross-machine direction to accommodate variations in the width of the web as shown in FIG. 4.

The spacing of the curved headers 28 as shown in FIG. 1 may follow the design of known header arrangements. The ducting arrangements which provide supply air to the nozzles 14 and remove the exhaust therefrom are also similar in design to ducts used with known floater dryers. The number of nozzles 14 which are arranged around a curved header depends on the angle of turn required. In addition, the nozzle spacing can be adjusted within practical limits to accommodate specific application objectives.

A pressure tap 42 (FIG. 1) may be included to act as a control sensor. The magnitude of pressure of the flow between the nozzles and the web depends on the web tension, and the pressure tap 42 allows the pad pressure to be measured. The pressure itself is controlled by the supply pressure to the nozzles 14, and the supply pressure can be adjusted in response to the pressure measured by the tap 42.

Figure 6:
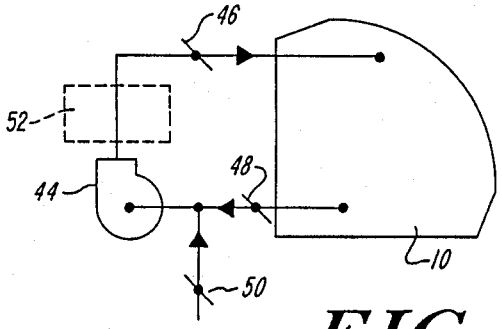
FIG. 6 is a schematic diagram of a recirculating flow utilized by the nozzle of the present invention shown in FIG. 1.

The overall air supply to the apparatus 10 is best shown by the schematic of FIG. 6. A fan 44 supplies air to the apparatus 10 of the present invention through a control damper 46. A return damper 48 and a makeup damper 50 complete the external circuit. A heat source 52 enables the apparatus 10 to supply heated air to perform web drying as well as turning.

As mentioned above, to intensify drying it is desirable to apply heat to both sides of a web 12. Such an application of heat, however, must be accomplished in a manner which avoids disrupting the web stability provided by the combination of the cushion pressure and the web tension.

Figure 7:
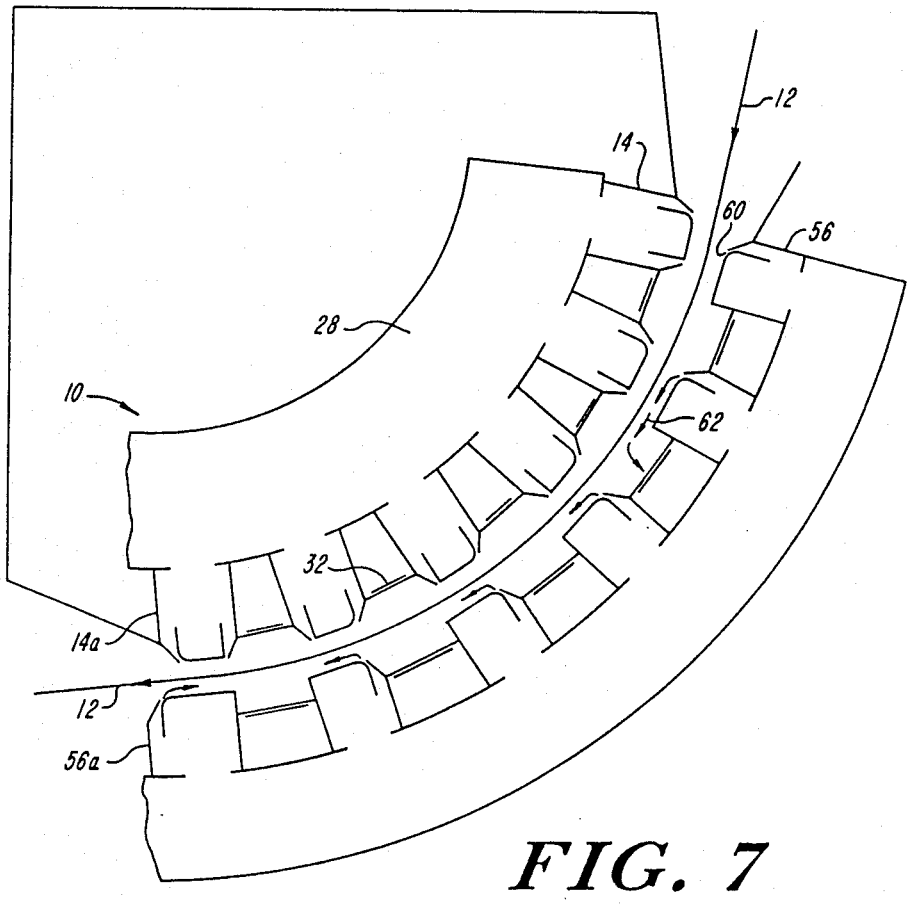
FIG. 7 is a sectional schematic view of an alternate embodiment of the apparatus of the present invention.

In the alternate embodiment shown in FIG. 7, a second series of nozzles 56 of the type taught by U.S. Pat. No. 3,587,177 are arranged opposite the nozzles 14. As discussed above, nozzles taught by U.S. Pat. No. 3,587,177 generate a negative pressure rather than a positive pressure as generated by nozzles 14. By placing such nozzles 56 on the convex side of the web 12, the nozzles 56 can actually provide a small degree of suction to further add to web stability as the web makes the turn. As shown in FIG. 7, the positive pressure nozzles 14 are arranged in a manner similar to that discussed above with reference to the embodiment of FIG. 1, i.e. about the concave side of the apparatus 10. The construction of the negative pressure nozzles 56 is similar to that of the positive pressure nozzles 14 except that the nozzles 56 do not include an orifice for providing the secondary jet flow of air to the web 12. The orifice 60 for the primary jet flow 62 operates in a manner similar to the orifice 18 insofar as the orifice 60 utilizes the Coanda effect to direct the primary flow 62 in a direction substantially parallel to the face of the nozzles 56. A nozzle **56*a* is arranged in a reversed position relative to the other nozzles 56 in a manner similar to the nozzle 14*a*. The apparatus 10 shown in FIG. 7 offers advantages over the apparatus of FIG. 1 since the FIG. 7** apparatus not only provides enhanced web stability, but it also provides a means of drying both sides of a web concurrently with transporting a web over a nonlinear path.

While the foregoing invention has been described with reference to its preferred embodiments, various alterations and modifications will occur to those skilled in the art. For example, instead of providing a set of negative pressure nozzles 56 about the convex side of the web, drying heat may be supplied to the convex side of the web through the use of electric or gas fired infrared devices. In addition, while the invention has been described as transporting the web along a path which is approximately 90′, the path could comprise any angle and the web could be transported along multiple paths. These and all other such modifications and alterations are intended to fall within the scope of the appended claims.

What is claimed is:

1. An apparatus for transporting a continuous web along a non-linear path the apparatus comprising:

a plurality of nozzles for providing a moving pad of air for supporting the web as the web travels along the non-linear path, said plurality of nozzles being arranged along said non-linear path so that a face of each of said plurality of nozzles is substantially parallel to the adjacent transported web, each of said plurality of nozzles including a first orifice for providing a primary jet flow of fluid directed in a first direction parallel to the non-linear path and a second orifice for providing a secondary jet flow of fluid in a direction substantially perpendicular to the non-linear path of travel of the web;

means for supplying a fluid to said plurality of nozzles;

a plurality of dampers for controlling exhaust of said primary jet flow and said secondary jet flow, said dampers being adjustable to enable the regulating of said pad of air, said dampers extending across the width of the surface of the web being transported; and deckles placed at cross-machine edges at each of said dampers.

* * * * *